US007854886B2

(12) United States Patent
Tamaki et al.

(10) Patent No.: US 7,854,886 B2
(45) Date of Patent: Dec. 21, 2010

(54) PRODUCTION METHOD FOR METAL MATRIX COMPOSITE MATERIAL

(75) Inventors: Yuichi Tamaki, Inazawa (JP); Kazuto Sanada, Shizuoka (JP); Toshimasa Nishiyama, Shizuoka (JP)

(73) Assignees: Nippon Light Metal Co., Ltd., Tokyo (JP); Nikkeikin Aluminum Core Technology Co., Ltd., Tokyo (JP)

( * ) Notice: Subject to any disclaimer, the term of this patent is extended or adjusted under 35 U.S.C. 154(b) by 549 days.

(21) Appl. No.: 11/976,329

(22) Filed: Oct. 23, 2007

(65) Prior Publication Data

US 2009/0104066 A1 Apr. 23, 2009

(51) Int. Cl.
*B22F 3/18* (2006.01)
*B22F 7/04* (2006.01)

(52) U.S. Cl. ..... 419/8; 419/43; 419/50

(58) Field of Classification Search ..... 419/8, 419/50

See application file for complete search history.

(56) References Cited

U.S. PATENT DOCUMENTS

| | | | | |
|---|---|---|---|---|
| 4,027,377 | A * | 6/1977 | Roszler | 419/50 |
| 4,126,451 | A | 11/1978 | Nayar | |
| 4,824,624 | A | 4/1989 | Palicka et al. | |
| 6,059,902 | A | 5/2000 | Yoshihara et al. | |
| 6,602,314 | B1 * | 8/2003 | Sakaguchi et al. | 75/249 |
| 2005/0106056 | A1 | 5/2005 | Peng et al. | |
| 2007/0010391 | A1 | 1/2007 | Mikijelj et al. | |
| 2007/0064860 | A1 | 3/2007 | Kusui et al. | |

FOREIGN PATENT DOCUMENTS

| | | | |
|---|---|---|---|
| EP | 1837103 | A | 9/2007 |
| JP | 52-120207 | A | 10/1977 |
| JP | 63-125601 | A | 5/1988 |
| JP | 2001-329302 | A | 11/2001 |
| JP | 2007-040914 | A | 2/2007 |
| WO | WO 2004/038050 | A | 5/2004 |
| WO | 2004/102586 | A | 11/2004 |
| WO | WO 2006/070879 | A | 7/2006 |

* cited by examiner

*Primary Examiner*—Roy King
*Assistant Examiner*—Ngoclan T Mai
(74) *Attorney, Agent, or Firm*—Smith Patent Office

(57) ABSTRACT

A method of producing an aluminum matrix composite material is described that comprises the steps of: mixing an aluminum powder and a ceramic powder to prepare a mixed powder; providing a lower casing made of aluminum and formed in a hollow rectangular parallelepiped shape having an open top, and a closing member made of aluminum and formed in a shape adapted to hermetically close the open top of the lower casing; packing the mixed powder into the lower casing; closing the open top of the lower casing filled with the mixed powder, by the closing member, to prepare a pre-rolling assembly having the mixed powder hermetically sealed therein; preheating the pre-rolling assembly; and rolling the preheated assembly to obtain the aluminum matrix composite material, where the aluminum matrix composite material includes a pair of metal plates having the mixed powder therebetween.

21 Claims, 6 Drawing Sheets

● : CONDITIONS ALLOWING FOR ROLLING WITHOUT PEELING

△ : CONDITIONS CAUSING PEELING

PRODUCTION METHOD FOR METAL MATRIX COMPOSITE MATERIAL

BACKGROUND OF THE INVENTION

1. Field of the Invention

The present invention generally relates to a production method for a metal matrix composite material. More specifically, the present invention relates to a production method for a metal matrix composite material excellent in properties, such as plastic workability, thermal conductivity, room-temperature or high-temperature strength, high stiffness, neutron absorption performance, wear resistance and low thermal expansibility.

2. Description of the Related Art

Heretofore, there has been known a method of producing a composite material having an aluminum matrix through a powder metallurgy process, comprising the steps of:

(1) mixing a powder of a ceramic material serving as a reinforcing material, such as $Al_2O_3$, SiC, $B_4C$, BN, aluminum nitride or silicon nitride, with an aluminum powder serving as a matrix;

(2) subjecting the mixed powder to canning or cold compaction to form a compact;

(3) subjecting the compact to degassing, sintering, etc.; and (4) forming the sintered compact into a desired shape.

The sintering process in the step (3) includes: a technique (A) of simply heating the compact; a technique (B) of pressing the compact at high temperatures, such as hot pressing; a technique (C) of sintering the compact through hot plastic working, such as hot extruding, hot forging or hot rolling; a technique (D) of pressing the compact while applying a pulse current thereto, i.e., subjecting the compact to so-called "pulse-current pressure sintering" (as disclosed, for example, in JP 2001-329302A); and a technique (E) based on a combination of two or more of the techniques (A) to (D). There has also been known a technique of performing the sintering process in conjunction with the degassing process.

In recent years, aluminum matrix composite materials have been increasingly developed for use in new applications requiring not only strength but also a high Young's modulus, wear resistance, low thermal expansibility and nuclear-radiation absorption capability. Although each of the functions can be enhanced by increasing an amount of ceramic additives having the respective functions, an approach of simply increasing the amount of ceramic additives will cause significant deterioration in sinterability and plastic workability, such as, extrudability, rollability or forgeability.

From this standpoint, there has been proposed a technique of preparing a ceramic preform, and impregnating the ceramic preform with molten aluminum alloy to allow ceramic particles to be uniformly dispersed over an aluminum alloy matrix in a high density. In reality, this technique is likely to involve problems about insufficiency of the impregnation with the molten aluminum alloy, and occurrence of defects, such as shrinkage during solidification of the molten aluminum alloy.

International Publication No. WO 2006/070879 relates to a method of producing an aluminum matrix composite material, which comprises the steps of: (a) mixing an aluminum powder and a ceramic powder to prepare a mixed powder; (b) subjecting the mixed powder to pulse-current pressure sintering together with a metal sheet to form a cladded material where a sintered compact is cladded with the metal sheet; and (c) subjecting the cladded material to plastic working to obtain an aluminum matrix composite material.

In WO 2006/070879, before a mixed powder prepared by mixing an aluminum powder and a ceramic powder is subjected to a rolling process, it is necessary to subject the mixed powder to pulse-current pressure sintering while sandwiching the mixed powder between metal sheets, so as to preform a cladded material in such a manner as to be maintained in a predetermined shape. The reason is that it is difficult or substantially impossible to roll the cladded material unless it is performed by sintering in such a manner as to be maintained in a predetermined shape.

As described above, it is essential for WO 2006/070879 to preform the cladded material in such a manner as to be maintained in a predetermined shape, i.e., to subject the mixed powder to pulse-current pressure sintering, which leads to deterioration in process efficiency and difficulty in achieving an intended cost reduction. Thus, there remains a strong need for solving these problems.

SUMMARY OF THE INVENTION

In view of the above circumstances, it is a primary object of the present invention to provide a method capable of producing a metal matrix composite material with enhanced process efficiency in a simplified production process.

It is another object of the present invention to provide a method capable of producing a high-quality metal matrix composite material without the need for pulse-current pressure sintering.

It is yet another object of the present invention to provide a method capable of producing a metal matrix composite material while simplifying a process of sandwiching an aluminum composite powder between metal sheets to form a cladded metal matrix composite material.

It is still another object of the present invention to provide a method capable of producing a metal matrix composite material while reliably preventing cracking or the like from occurring in a process of subjecting a cladded metal matrix composite piece to rolling.

It is yet still another object of the present invention to provide a method capable of producing a metal composite material with enhanced productivity.

It is another further object of the present invention to provide a method capable of producing a metal composite material with an accurately controlled sheet thickness.

As used in this specification and claims, the term "aluminum" means both pure aluminum and an aluminum alloy.

Specifically, according to an aspect of the present invention, there is provided a method of producing a metal matrix composite material, which comprises the steps of mixing a metal powder and a ceramic powder to prepare a mixed powder, packing the mixed powder into a hollow and flat-shaped metal casing, hermetically closing the metal casing filled with the mixed powder to prepare a pre-rolling assembly, preheating the pre-rolling assembly, and rolling the preheated assembly.

In the method set forth in the aspect of the present invention, the pre-rolling assembly is formed by packing the mixed powder into the metal casing and hermetically closing the metal casing. Specifically, the pre-rolling assembly is formed in such a manner that the mixed powder, i.e., mixed fine particles, is sandwiched from above and below by two metal plates serving as top and bottom walls of the metal casing. Thus, after preheating, the pre-rolling assembly can be subjected to rolling to reliably form a cladded material in which a layer of the mixture of the metal powder and the ceramic powder is cladded from above and below by the metal plates.

In a specific embodiment of the present invention, the metal powder may be a powder of pure aluminum having a purity of 99.0% or more, or a powder of aluminum alloy comprising Al and 0.2 to 2 weight % of at least one selected from the group consisting of Mg, Si, Mn and Cr, wherein the ceramic powder is contained in an amount of 0.5 to 60 mass % with respect to 100 mass % of the mixed powder.

As compared with metal, the ceramic powder, i.e., ceramic particles, to be added as a reinforcing material, generally have extremely high hardness. Thus, if a metal powder containing a large amount of ceramic powder is sintered to form a sintered body, and the sintered body is subjected to rolling, in a conventional manner, ceramic particles in a surface of the sintered body are highly likely to act as a fracture origin leading to wrinkling or cracking in a plastic-worked product. This also involves a problem about accelerated wear of an extrusion die, a mill roll, a forging die, etc.

In contrast, any sintering process, such as pulse-current pressure sintering, is not included in the method of the present invention. Thus, a surface of the pre-rolling assembly is free from ceramic particles causing wear of an extrusion die or the like. This uniquely provides an advantage of being able to obtain a high-quality rolled product, as a first feature of the present invention.

Further, in advance of rolling, the mixed powder comprising the ceramic powder and the metal powder is packed in the hollow casing to allow the pre-rolling assembly to be maintained in a predetermined shape required for the rolling. This eliminates the need for pre-hardening the mixed powder by means of pulse-current pressure sintering, press working or the like, and uniquely provides an advantage of being able to simplify a production process, as a second feature of the present invention.

Further, in a process of cladding the mixed powder from above and below by metal plates, top and bottom walls of the hollow casing can serve as the upper and lower metal plates for forming a cladded material. Thus, a structure of a cladded material is obtained only by packing the mixed powder into the casing. This also facilitates simplifying the production process, as a third feature of the present invention.

In a preferred embodiment of the present invention, after mixing an aluminum powder as a metal powder and an ceramic powder to prepare a mixed powder, the packing step further includes the sub-step of vibrating the casing to increase a density of the mixed powder to be packed into the casing.

In a conventional method, a density of the mixed powder is increased to a value enough to allow the mixed powder to be maintained in a predetermined shape required for rolling. For example, it is necessary to increase a powder density up to 98% or more. Differently, in the present invention, the mixed powder is directly subjected to rolling, in powder form. Thus, a powder density to be maintained in a state after the mixed powder is packed in the casing, is enough to be about 65% at a maximum.

In a preferred embodiment of the present invention, a peripheral portion of the casing is surrounded by a reinforcing frame. That is, before rolling, an outer surface of the mixed powder is fully covered by a metal plate. This provides an advantage of being able to reliably prevent wrinkling or cracking from occurring in a top or lateral surface or an inside of a composite material obtained by the rolling.

These and other objects, features, and advantages of the present invention will become apparent upon reading the following detailed description along with the accompanying drawings.

DESCRIPTION OF THE PREFERRED EMBODIMENTS

Figure 1:
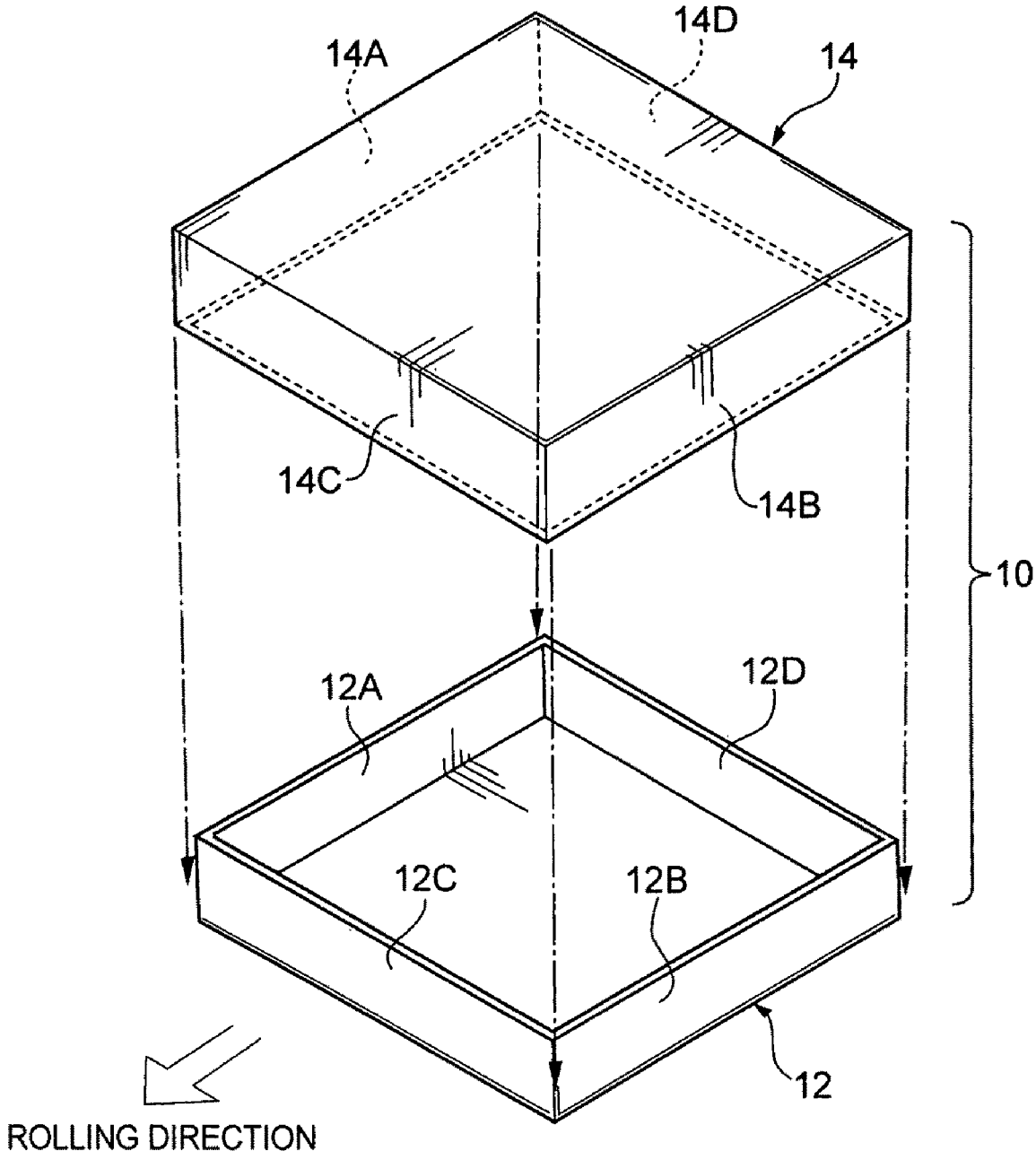
FIG. 1 is a perspective view showing the structure of a casing for use in a method according to a first embodiment of the present invention.

A method according to one aspect of the present invention comprises the steps of: (a) mixing a metal powder and a ceramic powder to prepare a mixed powder; (b) packing the mixed powder into a hollow and flat-shaped metal casing; (c) hermetically closing the metal casing filled with the mixed powder to prepare a pre-rolling assembly; (d) preheating the pre-rolling assembly; and (e) rolling the preheated assembly to obtain a metal matrix composite (MMC) material.

First Embodiment

The following description will be made about raw materials and then about the production process, in a method according to a first embodiment of the present invention.

(1) Raw Materials

Aluminum Powder serving as the Matrix

In a preferred embodiment, an aluminum powder serving as a matrix is made of an Al based alloy, specifically an aluminum alloy defined as A 1100 by JIS (or AA 1100 by A.A.). More specifically, the aluminum powder comprises 0.25 weight % or less of silicon (Si), 0.40 weight % or less of iron (Fe), 0.05 weight % or less of copper (Cu), 0.05 weight % or less of manganese (Mn), 0.05 weight % or less of magnesium (Mg), 0.05 weight % or less of chromium (Cr), 0.05 weight % or less of zinc (Zn), 0.05 weight % or less of vanadium (V) and 0.03 weight % or less of titanium (Ti), with the remainder being aluminum (Al) and inevitable impurities.

The aluminum powder in the present invention is not limited to the above specific composition. For example, pure aluminum (e.g., JIS 1050 or 1070) and various types of aluminum alloys, such as an Al—Cu based alloy (e.g., JIS 2017), an Al—Mg—Si based alloy (e.g., JIS 6061), an Al—Zn—Mg based alloy (e.g., JIS 7075) and an Al—Mn based alloy, may be used for the aluminum powder, independently or in the form of a combination of two or more of them.

That is, the composition of the aluminum powder may be selectively determined in consideration of desired characteristics or properties, resistance to deformation during subsequent forming/rolling processes, an amount of ceramic powder to be mixed therewith, a raw material cost, etc. For example, in view of obtaining enhanced plastic workability/formability and heat radiation performance, it is preferable to select a pure aluminum powder. As compared with aluminum alloy powders, the pure aluminum powder is advantageous in terms of a raw material cost. Preferably, the pure aluminum powder has a purity of 99.5% or more (a commercially available pure aluminum powder typically has a purity of 99.7% or more).

In case of giving neutron absorption capability to an aluminum matrix composite material, a boron compound is used for an after-mentioned ceramic powder. With a view to obtaining further enhanced neutron absorption capability, at least one element having neutron absorption capability, such as hafnium (Hf), samarium (Sm) or gadolinium (Gd), may be added to the aluminum powder, preferably in an amount of 0.1 to 50 mass %.

If it is necessary for an aluminum matrix composite material to have high-temperature strength, the aluminum powder may be added with at least one selected from the group consisting of titanium (Ti), vanadium (V), chromium (Cr), manganese (Mn), magnesium (Mg), iron (Fe), copper (Cu), nickel (Ni), molybdenum (Mo), niobium (Nb), zirconium (Zr) and strontium (Sr). If it is necessary for an aluminum matrix composite material to have room-temperature strength, the aluminum powder may be added with at least one selected from the group consisting of silicon (Si), iron (Fe), copper (Cu), magnesium (Mg) and zinc (Zn). In these cases, each of the above elements may be added in an amount of 7 weight % or less, and two or more of the above elements may be added in a total amount of 15 mass % or less.

While an average particle size of the aluminum powder is not limited to a specific value, an upper limit of the average particle size may be typically set at 200 μm or less, preferably 100 μm or less, more preferably 30 μm or less. A lower limit of the average particle size may also be freely determined in consideration of manufacturability, and may be typically set at 0.5 μm or more, preferably 10 μm or more. In particular, a particle size distribution of the aluminum powder may be set at 100 μm or less, and an average particle size of the after-mentioned ceramic powder serving as a reinforcing material may be set at 40 μm or less. In this case, the reinforcing particles are uniformly dispersed over the aluminum powder to significantly reduce a low density region of the mixed powder so as to effectively provide stable properties to the MMC plate.

An excessive difference between respective average particle sizes of the aluminum powder and the after-mentioned ceramic powder is likely to cause wrinkling or cracking during rolling. An excessively large average particle size of the aluminum powder causes difficulty in being uniformly mixed with the after-mentioned ceramic powder having a restriction on increasing an average particle size. Conversely, an excessively small average particle size of the aluminum powder is likely to cause aggregation of the aluminum fine particles, which leads to significant difficulty in being uniformly mixed with the after-mentioned ceramic powder. The aluminum powder having an average particle size set in the above preferable range can provide further enhanced plastic workability/formability and mechanical properties to the pre-rolling assembly.

An average particle size of the aluminum powder in the present invention is expressed by a value based on a laser-diffraction particle-size-distribution measurement method. A particle shape of the aluminum powder is not limited to a specific one. For example, the aluminum powder may have a teardrop shape, a perfect spherical shape, a spheroidal shape, a flake shape or an amorphous shape, without any problems.

A production method for the aluminum powder is not limited to a specific one. For example, the aluminum powder may be prepared by any conventional metal powder production method. For example, the conventional method may include an atomization process, a melt spinning process, a rotating disk process, a rotating electrode process, and other rapid solidification processes. In view of industrial production, it is preferable to select the atomization process, particularly a gas atomization process of atomizing molten metal to produce fine particles.

Preferably, the molten metal is subjected to the atomization process while being heated at a temperature ranging from 700 to 1200° C., because atomization of the molten metal can be effectively achieved when a temperature of the molten metal is set in the above range. An atomizing medium may be air, nitrogen, argon, helium, carbon dioxide or water, or a mixed gas thereof. In view of economic efficiency, air, nitrogen gas or argon gas is preferable as the atomizing medium.

Ceramic Powder

A ceramic material to be mixed with the aluminum powder so as to form the mixed powder includes $Al_2O_3$, SiC, $B_4C$, BN, aluminum nitride and silicon nitride. These ceramic materials may be used in powder form, independently or in the form of a mixture of two or more of them, and may be selected depending on an intended purpose of an aluminum matrix composite material. When a boron-based ceramic powder is used, an aluminum matrix composite material to be obtained can be used as a neutron-absorbing material, because boron (B) has neutron absorption capability. In this case, a boron-based ceramic material may include $B_4C$, $TiB_2$, $B_2O_3$, FeB and $FeB_2$. These boron-based ceramic materials may be used in powder form, independently or in the form of a mixture of two or more of them. In particular, it is preferable to use boron carbide ($B_4C$) largely containing 10B which is the isotope of B and capable of excellently absorbing neutrons.

The ceramic powder is contained in the aforementioned aluminum powder preferably in an amount of 0.5 to 90 mass %, more preferably 5 to 60 mass %, particularly preferably 5 to 45 mass %. The reason for the lower limit set at 0.5 mass % is that, if the content of ceramic powder becomes less than 0.5 mass %, an aluminum matrix composite material cannot be adequately reinforced. The reason for the upper limit set at 90 mass % is that, if the content of ceramic powder becomes greater than 90 mass %, an aluminum matrix composite material will have difficulty in plastic working due to increased resistance to deformation, and a compact therein will be likely to fracture due to a brittle structure. Moreover, a bonding between aluminum particles and ceramic particles will deteriorate, and thereby the compact is highly likely to have voids therein to cause difficulty in obtaining intended functions and deterioration in thermal conductivity. Further, a cutting performance of the aluminum matrix composite material will deteriorate.

The ceramic powder, such as a $B_4C$ or $Al_2O_3$ powder, may have any average particle size. Preferably, the average particle size of the ceramic powder is set in the range of 1 to 30 μm. As described in connection with the average particle size of the aluminum powder, a difference between respective average particle sizes of the two powders is preferably selected by requirement. For example, the average particle size of the ceramic powder is more preferably set in the range of 5 to 20

μm. If the average particle size of the ceramic powder becomes greater than 20 μm, an aluminum matrix composite material will have a problem that saw teeth are rapidly worn during cutting. If the average particle size of the ceramic powder becomes less than 5 μm, aggregation of fine ceramic particles is highly likely to occur to cause difficulty in being uniformly mixed with the aluminum powder.

An average particle size of the ceramic powder in the present invention is expressed by a value based on a laser-diffraction particle-size-distribution measurement method. A particle shape of the ceramic powder is not limited to a specific one. For example, the ceramic powder may have a teardrop shape, a perfect spherical shape, a spheroidal shape, a flake shape or an amorphous shape.

Casing

Each of a metal casing, upper and lower casings, a casing body and a plug member (hereinafter referred to collectively as "casing") for use in the method of the present invention may be made of any metal capable of being adequately bonded with the mixed powder. Preferably, the casing is made of aluminum or stainless steel. For example, in the casing made of aluminum, pure aluminum (e.g., JIS 1050 or 1070) is usually used. Alternatively, various types of aluminum alloys, such as an Al—Cu based alloy (e.g., JIS 2017), an Al—Mg based alloy (e.g., JIS 5052), an Al—Mg—Si based alloy (e.g., JIS 6061), an Al—Zn—Mg based alloy (e.g., JIS 7075) and an Al—Mn based alloy, may be used for the casing.

A composition of the aluminum may be selectively determined in consideration of desired characteristics or properties, cost, etc. For example, in view of obtaining enhanced plastic workability/formability and heat radiation performance, it is preferable to select pure aluminum. As compared with aluminum alloys, pure aluminum is advantageous in terms of a raw material cost. In view of obtaining further enhanced strength and plastic workability, it is preferable to select an Al—Mg based alloy (e.g., JIS 5052). With a view to obtaining further enhanced neutron absorption capability, at least one element having neutron absorption capability, such as Hf, Sm or Gd, may be added to the aluminum.

(2) Production Process 2-1: Mixed Powder Preparation Process

An aluminum powder and a ceramic powder are prepared and uniformly mixed together. The aluminum powder may be a single type, or may be a mixture of plural types of aluminum powders. The ceramic powder may be a single type, or may be a mixture of plural types of ceramic powders, for example, a mixture of $B_4C$ and $Al_2O_3$ powders. The aluminum powder and the ceramic powder may be mixed in a conventional manner using any type of mixer, such as a V blender or a cross rotary mixer or a drum blender; or a planetary mill, for a predetermined time (e.g., about 10 minutes to 10 hours). The mixing may be dry mixing or may be wet mixing. With a view to grinding during mixing, a grinding medium, such as alumina or SUS balls, may be appropriately added.

Fundamentally, the mixed-powder preparation process consists only of the step of mixing the aluminum and ceramic powders to prepare a mixed powder, and the obtained mixed powder is sent to a next step.

2-2: Casing Preparation Process

In a casing preparation process, a hollow and flat-shaped metal casing for packing the mixed powder prepared through the above mixed powder preparation process is prepared.

Specifically, a lower casing 12 and an upper casing 14 are prepared to form the metal casing 10. The lower casing 12 is made of aluminum, and formed in a shape which has opposed lateral walls 12A, 12B, a front wall 12C, a rear wall 12D as shown in FIG. 1, and a bottom wall 12E as shown in FIG. 2B. The upper casing 14 is made of aluminum, i.e., made of the same material as that of the lower casing 12, and formed in a shape which has opposed lateral walls 14A, 14B, a front wall 14C, a rear wall 14D as shown in FIG. 1 and a top wall 14E as shown in FIG. 2B. More specifically, the lower casing 12 is formed in a rectangular parallelepiped shape which has a closed bottom and an open top, and the upper casing 14 is formed in an approximately rectangular parallelepiped shape adapted to cover an outer peripheral surface of the lower casing 12 from above so as to serve as a closing member for closing the open top of the lower casing 12. That is, the upper casing 14 is formed to have a size slightly greater than that of the lower casing 12.

2-3: Reinforcing Frame Preparation Process

Figure 2A:
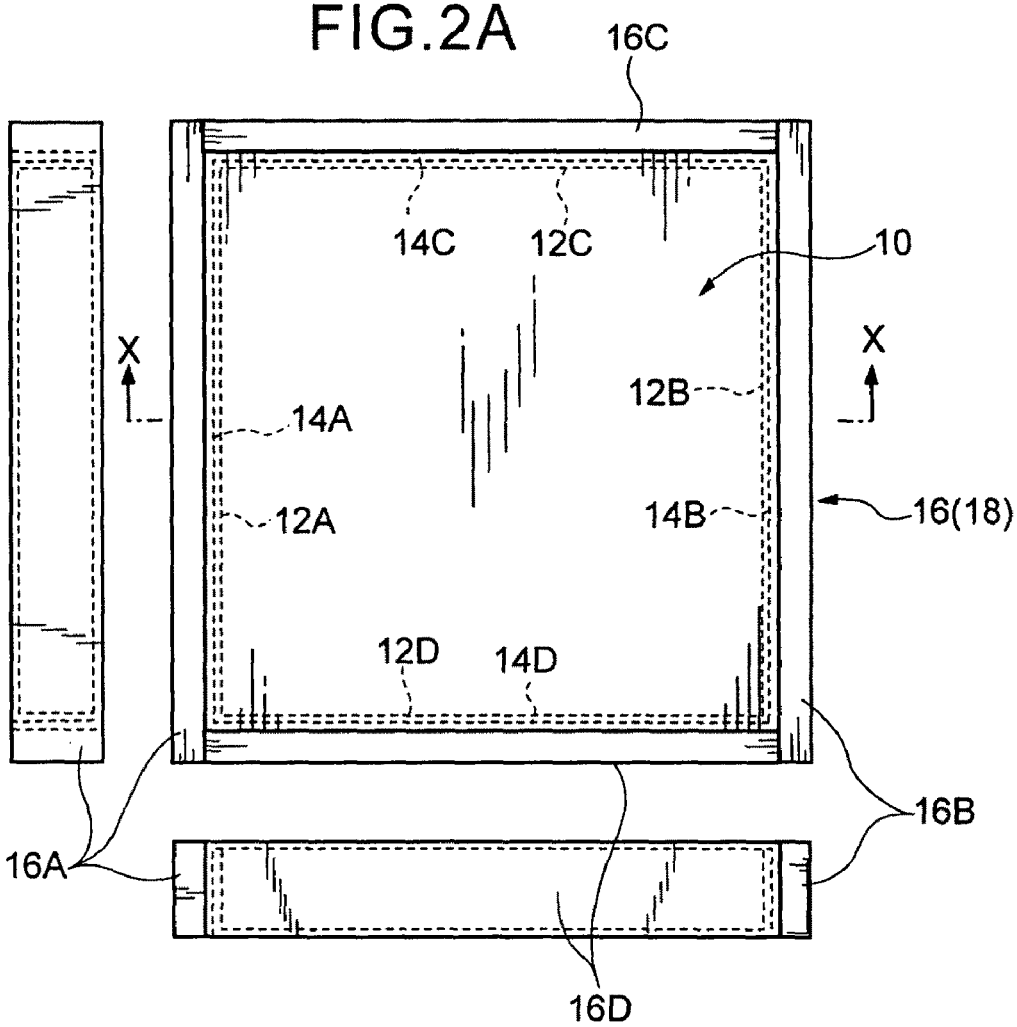
FIG. 2A illustrates the structure of a reinforcing frame for use in the method according to the first embodiment.
Figure 2B:
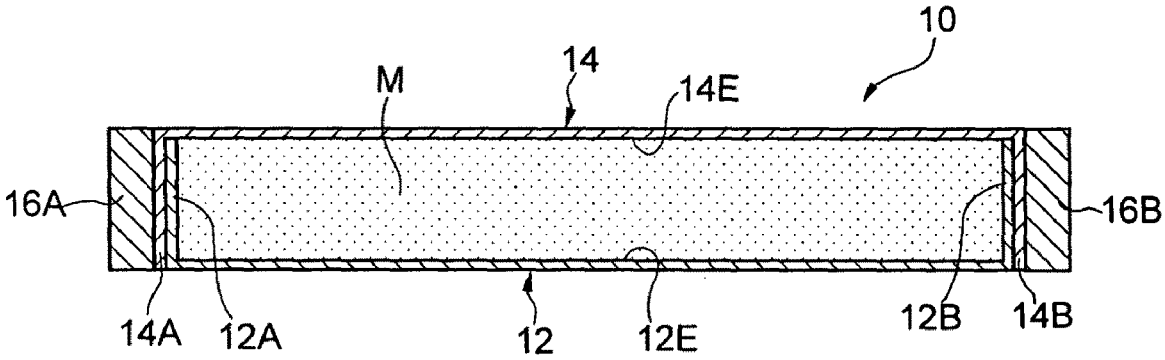
FIG. 2B is a vertical cross sectional view showing the casing in which the mixed powder is packed therein.

A reinforcing frame 16 for reinforcing an outer peripheral surface of the casing 10, specifically an outer peripheral surface of the casing 10 in a posture during rolling as shown in FIG. 2A, after an after-mentioned packing process, is prepared. The posture of the casing 10 during rolling means a state when the casing 10 is positioned in such a manner that a longitudinal axis thereof (any central axis of the casing 10 when it has a square shape in top plan view) extends along a rolling direction and a surface thereof to be rolled extends along a horizontal direction.

The reinforcing frame 16 comprises first and second reinforcing members 16A, 16B adapted to be fixed to respective ones of the opposed lateral surfaces (walls) 14A, 14B of the upper casing 14 each parallel to the rolling direction, in such a manner as to extend along the rolling direction, and third and fourth reinforcing members 16C, 16D adapted to be fixed to respective ones of the front surface (wall) 14C and the rear surface (wall) 14D of the upper casing 14 each orthogonal to the rolling direction, in such a manner as to extend along a direction orthogonal to the rolling direction.

Each of the first and second reinforcing members 16A, 16B is formed to have a length allowing front and rear ends thereof located along the rolling direction to extend beyond respective ones of front and rear ends of a corresponding one of the lateral surfaces 14A, 14B of the upper casing 14, when the first and second reinforcing members 16A, 16B are fixed to the respective lateral surfaces 14A, 14B. Each of the third and fourth reinforcing members 16C, 16D is formed to have a length equal to a length of a corresponding one of the front and rear surfaces 14C, 14D of the upper casing 14 in a direction orthogonal to the rolling direction, and is fixed with or secured to the first and second reinforcing members 16A, 16B 2-4: Packing Process Then, the mixed powder M prepared through the aforementioned mixed powder preparation process is packed into the lower casing 12. This packing process is performed as an operation of feeding the mixed powder M at a constant feed rate. In concurrence with the constant feeding operation, an operation of tapping or mechanical compaction of the lower casing 12 is performed to increase a density of the mixed powder M to be packed. Through the tap operation, a theoretical filling rate of the mixed powder M is set in the range of 35 to 65%. After completion of the tap operation, an excess mixed powder running over from the open top of the lower casing 12 is removed to allow the mixed powder M to be packed in the lower casing 12 in a full filling state.

Subsequently, the upper casing 14 is fitted onto the lower casing 12 from above to close the open top of the lower casing 12 so as to form a pre-rolling assembly 18 having the mixed powder M packed therein.

Then, an operation of reinforcing the pre-rolling assembly 18 by the reinforcing frame 16 is performed. The reinforcing operation is performed by surrounding an outer peripheral surface, except top and bottom surfaces, of the pre-rolling assembly 18 in a posture during rolling by the reinforcing frame 16, as shown in FIG. 2B.

More specifically, each of the first and second reinforcing members 16A, 16B is temporarily fixed to a corresponding one of the lateral surfaces 14A, 14B of the upper casing 14, in such a manner that opposite ends (i.e., the front and rear ends) thereof located along the rolling direction extends beyond respective ones of the front and rear ends of the corresponding one of the lateral surfaces 14A, 14B. Then, the third reinforcing member 16C is temporarily fixed to the front surface 14C of the upper casing 14, in such a manner that the opposite lateral ends thereof come into contact with the respective front ends of the first and second reinforcing members 16A, 16B, and the fourth reinforcing member 16D is temporarily fixed to the rear surface 14D of the upper casing 14, in such a manner that opposite lateral ends thereof come into contact with the respective rear ends of the first and second reinforcing members 16A, 16B.

The pre-rolling assembly 18 having the reinforcing frame 16 temporarily fixed thereto is put in a vacuum furnace, and the vacuum furnace is depressurized to a predetermined degree of vacuum so as to subject the mixed powder M in the pre-rolling assembly 18 to degassing.

After completion of the degassing operation, the temporarily fixed reinforcing frame 16 is finally fixed by MIG (metal inert gas) welding. Through the MIG welding, an upper edge of the reinforcing frame 16 is welded to an upper edge of the upper casing 14 all around, and a lower edge of the reinforcing frame 16 is welded to a lower edge of the upper casing 14 all around. In this state, the lower edge of the upper casing 14 is located in a closely adjacent relation to a lower edge of the lower casing 12. Thus, when the lower edge of the reinforcing frame 16 is welded to the lower edge of the upper casing 14, the lower edge of the lower casing 12 is also welded to the respective lower edges of the reinforcing frame 16 and the upper casing 14, so that the casing 10 is gas-tightly sealed in its entirety, that is the mixed powder M is hermetically sealed in the casing 10. In this invention, it is possible to at least use first and second reinforcing members 16A and 16B for reinforcing the casing 10. It is also possible to also use the third and fourth reinforcing members 16C and 16D along with the first and second reinforcing members 16A and 16B.

Due to the gas-tightly sealed casing 10, once air exists (remains) within the pre-rolling assembly 18, the air is likely to cause defects. From this point of view, a gas vent hole (not shown) is formed at each of four corners of a top wall of the upper casing 14 to release air (and other gas) from the pre-rolling assembly 18 so as to prevent the air from remaining within the pre-rolling assembly 18. It can also be expected to allow gas getting into the pre-rolling assembly 18 during the welding to be effectively released from the gas vent holes.

2-5: Preheating Process

Before rolling, the pre-rolling assembly 18 reinforced by the reinforcing frame 16 is preheated. This preheating is performed using a heating furnace in an ambient atmosphere at a temperature of 300 to 600° C. for a holding time of 2 hours or more. A preheating atmosphere is not limited to the ambient atmosphere. The preheating is preferably performed in an inert gas atmosphere, such as an argon gas atmosphere, more preferably a vacuum atmosphere of 5 Pa or less.

2-6: Rolling Process

In a rolling process, the preheated assembly is subjected to rolling as one of the plastic workings. In advance of the description on the rolling process, conditions of the pre-rolling or preheated assembly 18 for providing a unique advantage of the present invention will be described below.

The mixed powder in the pre-heated assembly to be subjected to the rolling process is maintained in powder form without being solidified. That is, the mixed powder is not subjected to a preforming process for allowing a mixed powder to be maintained in a predetermined shape, specifically a process of preforming a mixed powder in an intended shape through press working or pulse-current pressure sintering. In the present invention, although the mixed powder is packed in the pre-rolling assembly at a relatively high filling rate, the filling rate is not increased to a level allowing the mixed powder to be changed from the powder state.

In addition, when the mixed powder M maintained in powder form is subjected to the rolling process, it is sandwiched by metal or aluminum members from above and below. Specifically, a top surface of the mixed powder M is covered by the top wall 14E of the upper casing 14 fully and tightly, and a bottom surface of the mixed powder M is covered by the bottom wall 12E of the lower casing 12 fully and tightly. In this manner, the pre-rolling assembly 18 having the mixed powder M hermetically sealed in the casing 10 and sandwiched by the aluminum members from above and below is provided as a raw material of a plate-shaped cladded material.

The preheated assembly 18 is typically subjected to rolling and formed in an intended shape. In case of forming the preheated assembly 18 in a plate shape, a plate-shaped cladded material having a given clad rate of an Al plate and/or an Al casing can be obtained only through cold rolling. In hot plastic working, a single plastic working may be performed, or plural types of plastic workings may be performed in combination. Alternatively, after hot plastic working, cold plastic working may be performed. In case of performing cold plastic working, before the cold plastic working, the pre-rolling assembly may be subjected to annealing at a temperature of 300 to 600° C. (preferably 400 to 500° C.) to facilitate the cold plastic working.

The pre-rolling assembly 18 is cladded with the aluminum plates, and therefore a surface of the pre-rolling assembly 18 is free from ceramic particles which act as a fracture origin during plastic working and cause accelerated wear of a roll, die or the like. This makes it possible to provide enhanced rollability and obtain an aluminum matrix composite material excellent in strength and surface texture. In addition, an obtained hot plastic-worked product has a surface cladded with metal, and the metal clad is tightly bonded with the inner mixed powder M. Thus, the hot plastic-worked product is superior in corrosion resistance, impact resistance and thermal conductivity to an aluminum matrix composite material devoid of metal cladding a surface thereof.

In another preferred embodiment, before rolling, a surface of the pre-rolling assembly 18 is effectively covered by a protective plate, such as a thin plate made of SUS or Cu. This makes it possible to prevent occurrence of longitudinal (frontward/rearward) wrinkling or cracking which is likely to arise during plastic working.

More specifically, in the rolling process, the preheated assembly 18 is subjected to hot rolling at a draft (i.e., rolling reduction) ranging from 10 to 70%. A rolling temperature in the hot rolling is set at approximately 500° C.

The preheated assembly 18 may be finished to have a final thickness through this hot rolling. Alternatively, after this hot rolling, the hot-rolled assembly may be further subjected to warm rolling at a temperature of 200 to 300° C. Further, the assembly subjected to the first warm rolling may be subjected to second warm rolling at a temperature of 200° C. or less.

After completion of the rolling process, the rolled assembly is subjected to a heat treatment at a temperature of 300 to 600° C. for a predetermined time, i.e., to an annealing process. After completion of the annealing process, the annealed assembly is subjected to a cooling process, and a correcting process for obtaining a desired flatness. Then, opposite lateral edges and front and rear edges of the corrected assembly are cut off to obtain a product having a predetermined shape.

EXAMPLES

The method of the present invention according to the first embodiment will be more specifically described based on specific examples. Values of properties in each sample were measured in the following manner.

(1) Composition

A composition of each material was analyzed by an inductively-coupled plasma (ICP) emission spectrophotometric analysis method.

(2) Average Particle Size

An average particle diameter of each powder was measured by a laser diffraction particle size measurement method, using a particle size analyzer (Trade name "Microtrack" produced by Nikkiso Co., Ltd.). The average particle diameter is indicated by volume median diameter.

(3) Rollability

The presence or absence of cracking and a surface texture in each sample subjected to rolling were evaluated. A sample having surface cracking on a plate was evaluated as "x", and a sample having wrinkle-like irregularities without surface cracking was evaluated as "o". A sample having neither surface cracking nor irregularities was evaluated as "☺".

(4) Structure Observation

A specimen cut from each sample was embedded in resin, and subjected to emery grinding and buffing. Then, a metal structure of the specimen was observed by an optical microscope.

Example 1

A $B_4C$ ceramic powder was uniformly mixed with an aluminum alloy powder having a composition as shown in Table 1, in an amount of 35 mass %, to prepare a mixed powder M. Then, a lower casing 12 made of an aluminum alloy (JIS A5052P) and formed in an approximately rectangular parallelepiped shape having outside dimensions of 367.7 mm on a side in square-shaped top and bottom surfaces, and 31.6 mm in height, and a wall thickness of 1.6 mm was prepared. Further, an upper casing 14 made of an aluminum alloy (JIS A5052P) and formed in an approximately rectangular parallelepiped shape having outside dimensions of 370.9 mm on a side in square-shaped top and bottom surfaces, and 33.2 mm in height, and a wall thickness of 1.6 mm was prepared. The aluminum alloy (JIS A5052P) had a tensile strength of 195 MPa.

TABLE 1

| Si | Fe | Cu | Mn | Mg | Cr | Zn | V | Ti | Al |
|---|---|---|---|---|---|---|---|---|---|
| 0.25% or less | 0.40% or less | 0.05% or less | 0.05% or less | 0.05% or less | 0.05% or less | 0.05% or less | 0.05% or less | 0.05% or less | remainder |

Two aluminum plates each formed to have outside dimensions of 409.9 mm in length, 20.0 mm in width and 33.2 mm in height, a wall thickness of 2.0 mm, and a rectangular shape in section were prepared as first and second reinforcing members 16A, 16B constructing a reinforcing frame 16. Further, two aluminum plates each formed to have outside dimensions of 370.9 mm in length, 19.5 mm in width and 33.7 mm in height, a wall thickness of 2.0 mm, and an L shape in section were prepared as third and fourth reinforcing members 16C, 16D constructing a reinforcing frame 16. The reinforcing frame 16 (i.e., first to fourth reinforcing members 16A to 16D) was made of the same material (JIS A5052P) as that of the lower and upper casing 12, 14.

The mixed powder M was supplied into the lower casing 12 while tapping the lower casing 12. The tap operation was performed under the following conditions: vibration frequency=0.53 Hz; amplitude by vibration=50 mm; weight=5.4 kg; and time period of tap=3 minutes or more (set period: 3 minutes).

Then, an obtained pre-rolling assembly 18 was preheated at 500° C. for 2 hours or more, and rolled using a two-high rolling mill (400 KW, Φ870×900) at a rolling-initiation temperature of 500° C. and a rolling-end temperature of 100° C., to have a final thickness of 1.9 mm. After completion of the rolling, the rolled assembly was subjected to annealing at a temperature of 450° C. for 4 hours, and then cooled at 200° C.

Figure 3:
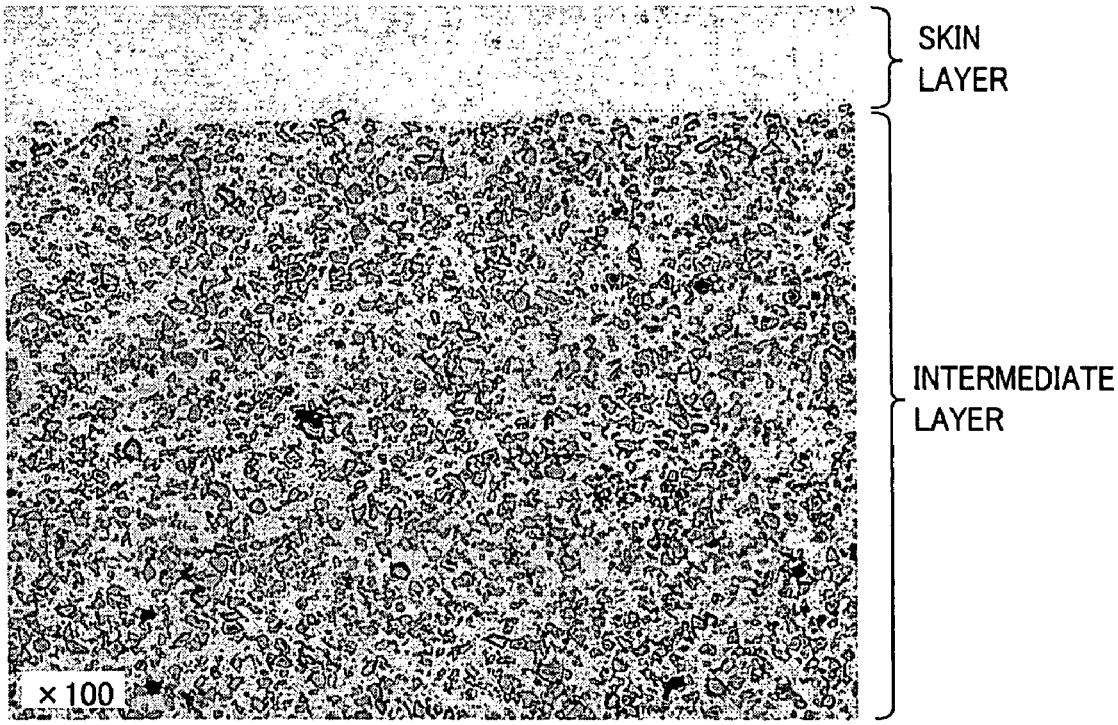
FIG. 3 is a microscope photograph showing a region (100 times magnified) around a skin layer of a cladded material as an end product obtained through a method of the present invention.
Figure 4:
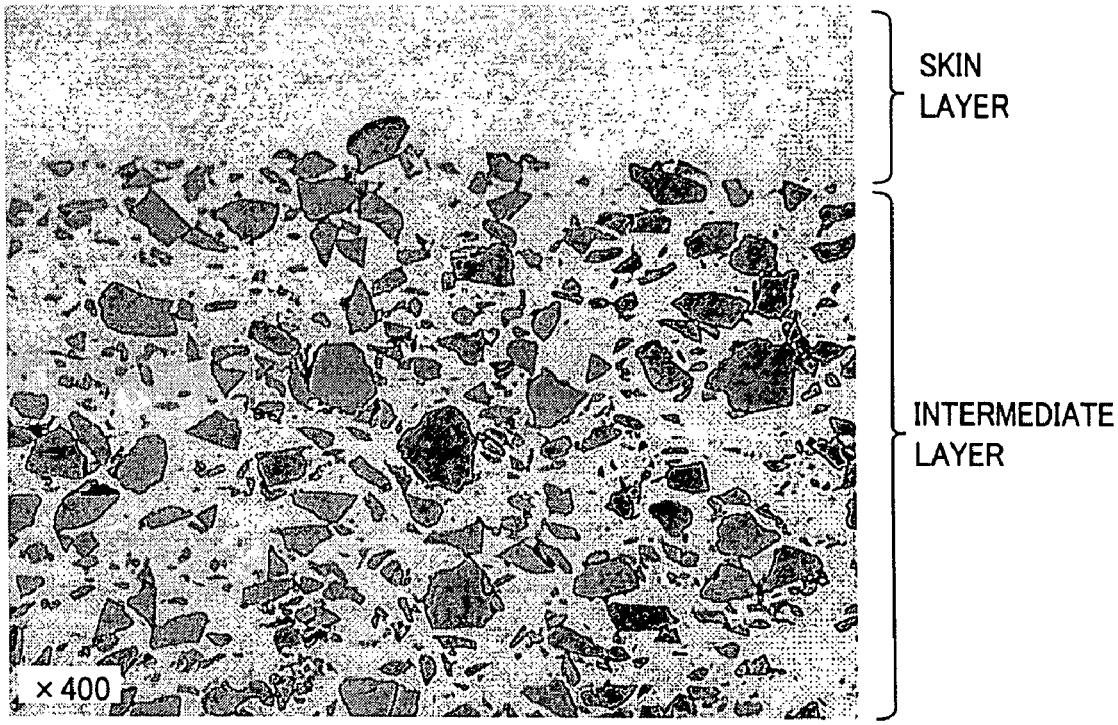
FIG. 4 is a microscope photograph partly showing the region (400 times magnified) around the skin layer in FIG. 3.
Figure 5:
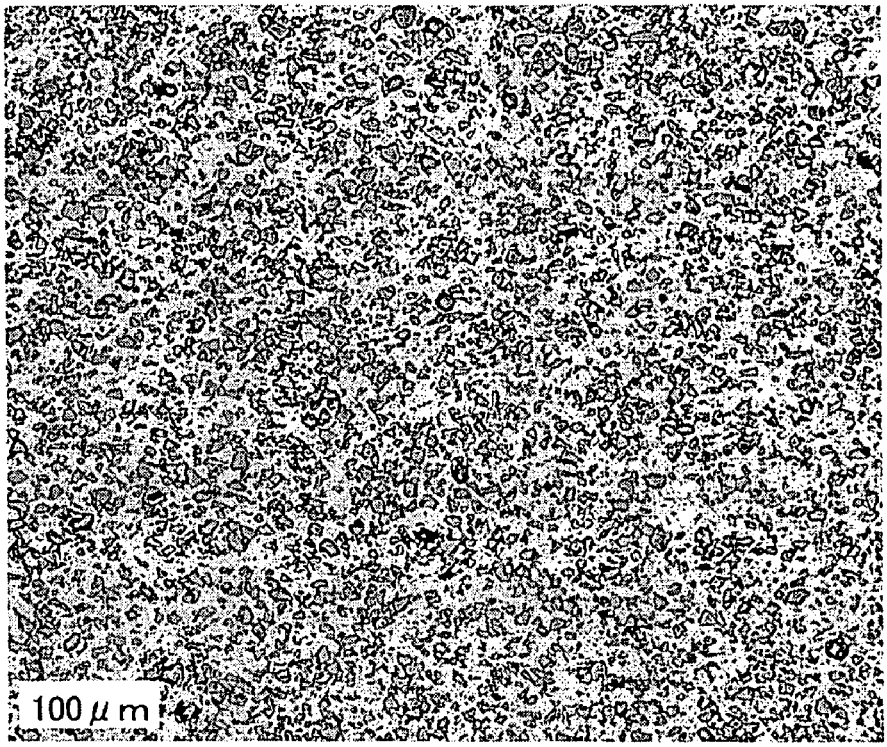
FIG. 5 is a microscope photograph showing a region of an intermediate layer (100 times magnified) of the cladded material in FIG. 3.
Figure 6:
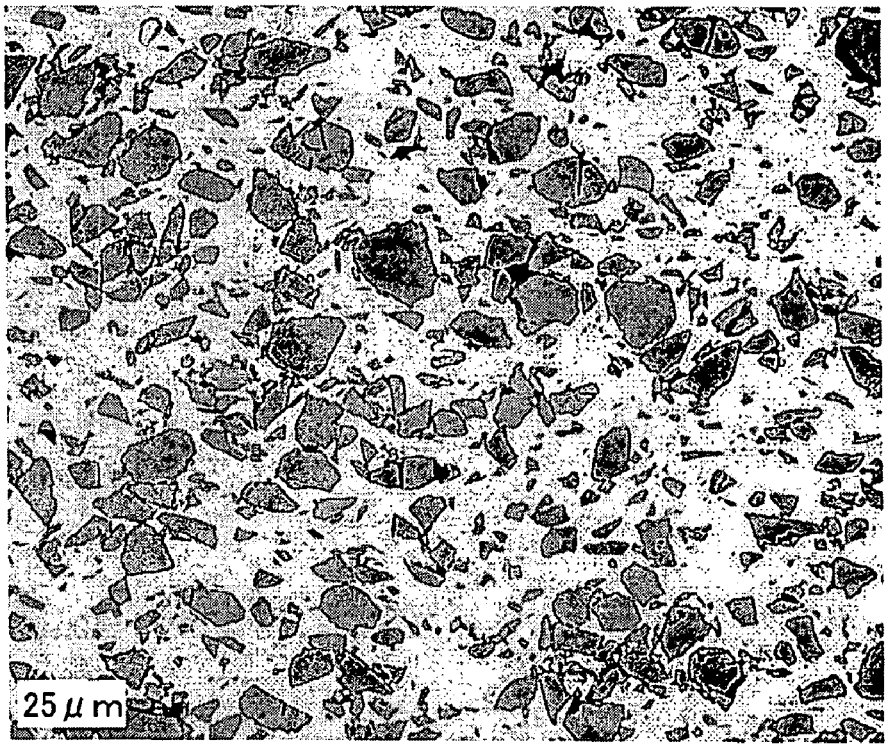
FIG. 6 is a microscope photograph partly showing the region of the intermediate layer (400 times magnified) in FIG. 5.

A specimen was collected from a cladded material (end product) obtained in the above manner, and a metal structure of the specimen was observed by an optical microscope. Microscope photographs of the metal structure are shown in FIGS. 3 to 6, wherein: FIG. 3 is a microscope photograph showing a region (100 times magnified) including a portion where a top wall 14E of the upper casing 14 appears as an upper skin layer; FIG. 4 is a microscope photograph partly showing the region (400 times magnified) in FIG. 3; FIG. 5 is a microscope photograph showing a region of an intermediate layer (100 times magnified) made up of the mixed powder M subjected to rolling; and FIG. 6 is a microscope photograph partly showing the region of the intermediate layer (400 times magnified) in FIG. 5.

As seen in the photographs of FIGS. 5 and 6, the specimen is rolled to have a sufficiently high density. As seen in the photographs of FIGS. 3 and 4, the upper skin layer formed from the top wall 14E of the upper casing 14 is tightly bonded with the inner mixed powder M.

The intermediate layer (i.e., a layer made up of the mixed powder M densified or solidified through the rolling) has a high theoretical density ratio of 95% or more which could not be achieved by conventional products (theoretical density ratio: a ratio of a computational density to a measured specific density).

Example 2

In order to clarify an optimal range of the width of the reinforcing frame 16, in addition to the reinforcing frame 16 in the Example 1 having a width of 20.0 mm, five types of reinforcing frames 16 were prepared by changing only the width to 5 mm, 10 mm, 15 mm, 30 mm and 40 mm. Except for this change, the product was made under the same conditions as those in the Example 1. Each of the prepared reinforcing frames 16 was welded to the pre-rolling assembly 18 to prepare five types of samples, and each of the samples was subjected to rolling in the same manner.

Further, an additional five types of reinforcing frames 16 were prepared by changing the material of the reinforcing frame 16 in the Example 1 to an aluminum alloy (JIS A6063) and then changing only the width to 5 mm, 10 mm, 15 mm, 30 mm and 40 mm. Except for these changes, the product was made under the same conditions as those in the Example 1. Each of the prepared reinforcing frames 16 was welded to the pre-rolling assembly 18 to prepare five types of samples, and each of the samples was subjected to rolling in the same manner. The aluminum alloy (JIS A6063) had a tensile strength of 95 MPa.

Rollability in each of the samples using the above reinforcing frames with different materials and/or widths were evaluated. The results are shown in Table 2.

TABLE 2

| Width of Reinforcing Frame (mm) | | | 5 | 10 | 15 | 20 | 30 | 40 |
|---|---|---|---|---|---|---|---|---|
| Material of Reinforcing Frame | A5052 | Evaluation of Rollability | x | ○ | ☺ | ☺ | ☺ | ☺ |
| | | Tensile Strength | | | 195 Mpa | | | |
| | A6063 | Evaluation of Rollability | x | x | ○ | ☺ | ☺ | ☺ |
| | | Tensile Strength | | | 95 Mpa | | | |
| Rate of width of Reinforcing Frame to width of casing | | | 1.36 | 2.72 | 4.08 | 5.44 | 8.16 | 10.88 |

From the result in Table 2, it was proven that each of the reinforcing members 16A to 16D making up the reinforcing frame 16 is required to have a width set to be 4% or more of a length of the upper casing 14 along a direction orthogonal to a rolling direction.

Example 3

Further, a test was conducted about desirable rolling conditions for allowing a bonding between the mixed powder M serving as the intermediate layer and each of the aluminum plate members (walls) 14E, 12E serving as upper and lower skin layers, to be maintained without peeling, during rolling.

Given that: a radius of a mill roll of a rolling mill for use in the rolling process is R; a thickness of the pre-rolling assembly 18 (before rolling) is H0; and a thickness of the rolled assembly (after the rolling) is H1 (i.e., (H0−H1) is a rolled amount per rolling process), it was found that a range satisfying the following two inequalities is the desired range, i.e., the above desirable conditions:

$$H0/SQRT(R*(H0-H1))\leqq 1.0$$

$$H0/SQRT(R*(H0-H1))\geqq 2.2$$

The "SQRT(R*(H0−H1))" in the above inequalities is a value defined as a contact arc length. That is, the left-hand side of each of the inequalities is equivalent to [(a thickness of the pre-rolling assembly 18)÷(a contact arc length)], and therefore a value of the left-hand side is defined as a shape ratio.

Based on this assumption, a state of peeling in the products produced (i.e., rolled) through the process in the Example 1 was verified. The verification result is shown in FIG. 7.

Figure 7:
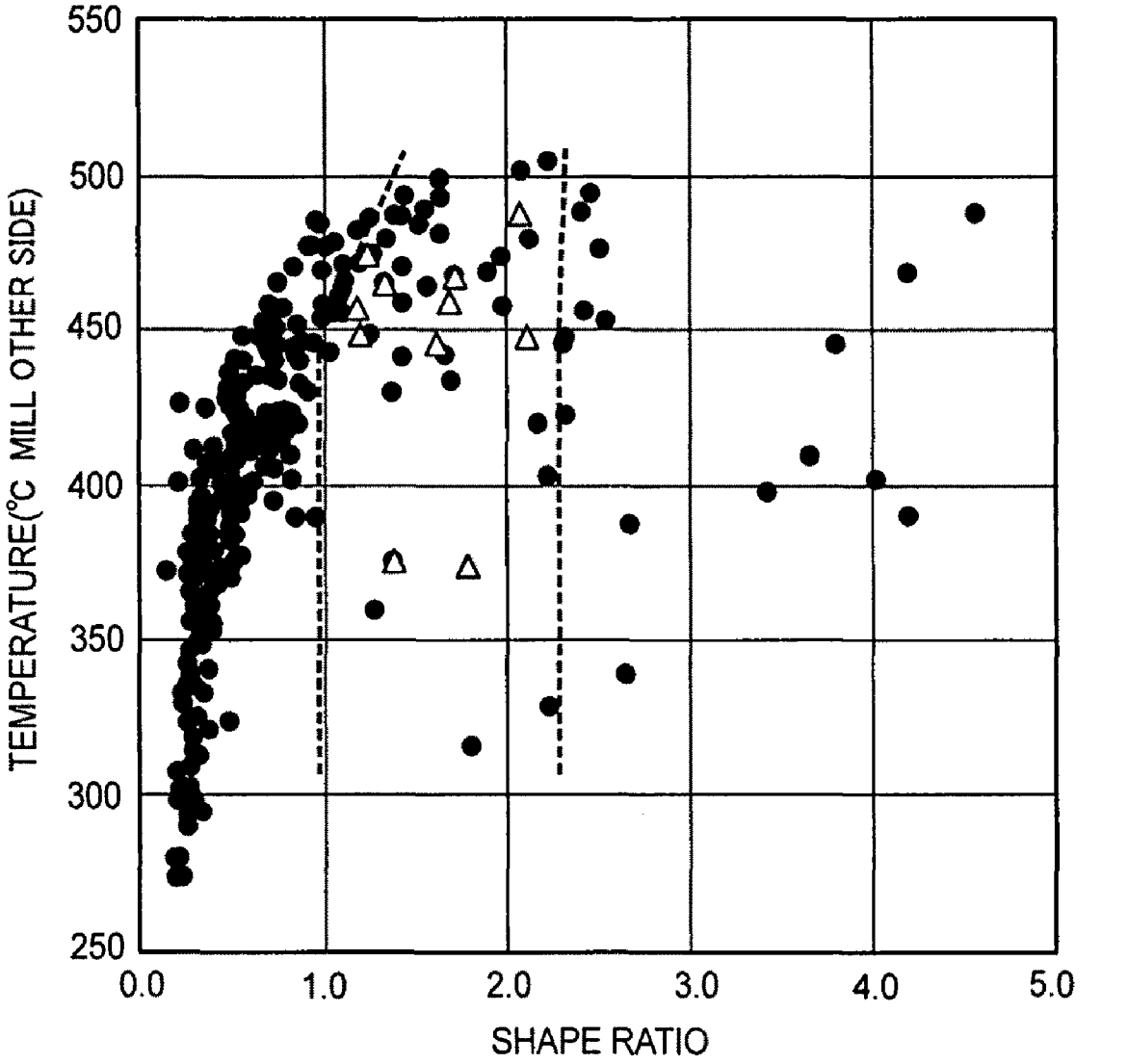
FIG. 7 is a graph showing peeling between a skin layer and an intermediate layer, in connection with a shape ratio and a mill outlet-side temperature.

As seen in FIG. 7, it was verified that the rolling process is completed without peeling if the shape ratio is 1.0 or less or 2.2 or more, and a peeling occurs during the rolling process if the shape ratio is in a range satisfying the following inequality: 1.0<shape ratio<2.2.

As above, in the method of the present invention, the rolling conditions for preventing peeling of the skin layers can be defined using the above inequalities.

While the first embodiment has been described based on one example where a matrix material of the mixed powder M comprises a $B_4C$ ceramic powder and an aluminum powder, the matrix material for use in the method of the present invention is not limited to such a composition. It is also understood that a primary component of the matrix material is not limited to aluminum, but may be a powder of any other suitable metal element, such as copper, magnesium, titanium, gallium, iron or indium.

Second Embodiment

While the first embodiment has been described based on one example where the casing 10 comprises the lower casing 12 and the upper casing 14, the casing used in the method of the present invention is not limited to such a structure, but may have any other suitable structure, for example, the structure of a casing 10' for use in a method according to a second embodiment of the present invention.

The method according to the second embodiment will be described below. The second embodiment is different from the first embodiment in only the casing 10', and other components, materials, production process, etc., are almost the same as those in the first embodiment. Thus, the following description will be made about only the casing 10' and the operation of packing and other duplicative descriptions will be omitted.

Figure 8:
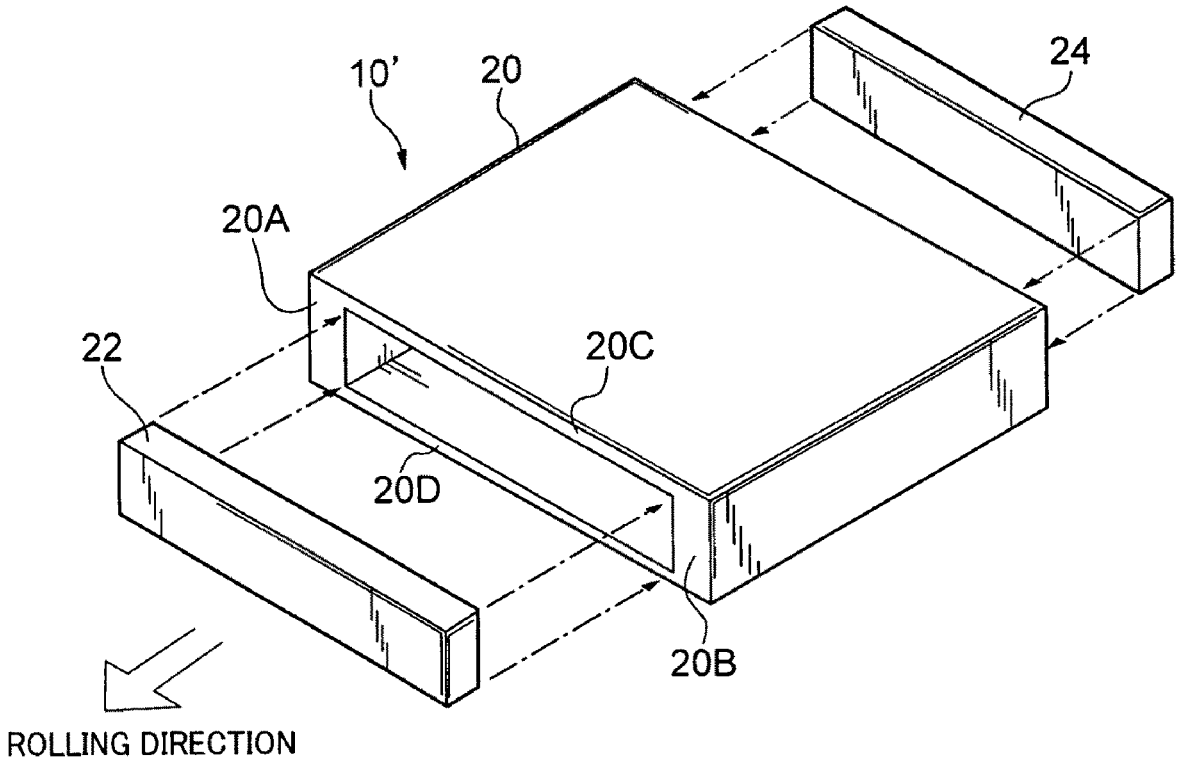
FIG. 8 is a perspective view showing the structure of a casing for use in a method according to a second embodiment of the present invention.

As shown in FIG. 8, the casing 10' in the second embodiment comprises a casing body 20 formed as a hollow member prepared through an extrusion process to have an inner hollow cavity which is fully opened to the outside in such a manner as to define front and rear open ends located along a rolling direction, a first plug member 22 is adapted to close the front open end, and a second plug member 24 is adapted to close the rear open end.

The casing body 20 is made of the same material (JIS A5052P) as that of the casing 10 (upper and lower casings 14, 12) in the first embodiment.

Different from the casing 10 in the first embodiment, the casing body 20 has an integral hollow structure prepared through an extrusion process, as mentioned above. More specifically, the casing body 20 is formed in a flat rectangular parallelepiped shape which integrally has opposed lateral walls 20A, 20B each extending along the rolling direction, and a top wall 20C and a bottom wall 20D. In a rolling process, the casing body 20 is positioned in such a posture (rolling posture) that a longitudinal axis thereof extends along the rolling direction and the top wall 20C (i.e., top surface) thereof to be rolled extends along a horizontal direction, and is subjected to rolling using a rolling mill in a direction from the front open end toward the rear open end.

Compared with the first embodiment, the bottom wall 20D and the top wall 20C in the second embodiment correspond, respectively, to the bottom wall 12E of the lower casing 12 and the top wall 14E of the upper casing 14 in the first embodiment. The lateral wall 20A in the second embodiment corresponds to a combination of the lateral wall 12A of the lower casing 12, the lateral wall 14A of the upper casing 14, and the reinforcing member 16A in the first embodiment. The lateral wall 20B in the second embodiment corresponds to a combination of the lateral wall 12B of the lower casing 12, the lateral wall 14B of the upper casing 14, and the reinforcing member 16B in the first embodiment.

The first plug member 22 is formed in a shape and size fittable into the front open end (specifically, a front opening) of the casing body 20 in a slidable manner to fully close the front open end. The first plug member 22 is fitted into the front open end of the casing body 20 in such a manner that an outer surface of the first plug member 22 becomes flush with a surface of the front open end, and then fixed to the casing body 20 by crimping or welding.

The first plug member 22 has a thickness in the rolling direction which is set at a value equal to a total thickness of the front wall 12C of the lower casing 12, the front wall 14C of the upper casing 14, and the reinforcing member 16C of the reinforcing frame 16, in the first embodiment.

The second plug member 24 is formed in a shape and size fittable into the rear open end (specifically, a rear opening) of the casing body 20 in a slidable manner to be able to push down a required depth and to fully close the rear open end. When the second plug member 24 is fitted into the rear open end of the casing body the second plug member 24 is fixed to the casing body 20 by crimping or welding. The second plug member 24 has a thickness in the rolling direction which is set at a value equal to a total thickness of the rear wall 12D of the lower casing 12, the rear wall 14D of the upper casing 14, and the reinforcing member 16D of the reinforcing frame 16, in the first embodiment.

The second plug member 24 is formed with a through-hole (not shown) penetrating therethrough along the rolling direction. The through-hole is serves as a gas vent (i.e., gas release) means to release gas from an inside of the casing body 20 during heating and rolling and is set to be closed by a plug or tape (not shown) during a transportation of the pre-rolling assembly as in the first embodiment.

Each of the first and second plug members 22, 24 is made of the same material as that of the casing body 20.

The casing 10', i.e., an assembly of the casing body 20 and the first and the second plug members 22, 24 fitted in the casing body 20, has outside dimensions equal to those of the pre-rolling assembly 18 (including the reinforcing frame 16) in the first embodiment, and inside dimensions equal to those of an inner hollow cavity defined by the upper and lower casings 14, 12 fitted together.

As above, the casing 10' in the second embodiment is integrally formed with the reinforcing frame 16 in the first embodiment.

The following description will be made about a packing process of packing the mixed powder M into the casing 10'.

Firstly, the first plug member 22 is fitted into the first open end of the casing body 20, and fixed by crimping the casing to gas-tightly close the front open end of the casing body 20. After closing the front open end of the casing body 20, the casing body 20 is positioned in an upstanding posture where the rear open end is located at a top of the casing body 20. Then, the mixed powder M is fed into the casing body 20 from the rear and upper open end thereof at a constant feed rate. The packing process is performed while tapping the casing body 20 or mechanical compaction so as to complete to fill a required quantity of the mixed powder M and increase a density of the mixed powder M to be packed into the casing body 20.

After the mixed powder M is fully packed in the casing body 20, then the second plug 24 is fitted into the rear open end (that is, the upper open end) of the casing body 20 and put on the upper surface of the mixed power M in the casing body 20. More specifically, this fitting operation is performed in such a manner that the second plug member 24 (specifically, a bottom surface of the second plug member 24) comes into contact with an upper surface of the mixed powder M packed in the casing body 20. Further, during the fitting operation, the tap operation is continuously performed. Thus, the density of the packed mixed powder M is further increased so that a bulk of the mixed powder M is gradually reduced, and the upper surface of the mixed powder M is gradually lowered. That is, the second plug member 24 will be gradually fitted into the casing body 20 according to the lowering of the upper surface of the mixed powder M.

The tap operation and the fitting operation are performed over a time enough to obtain a predetermined density of the mixed powder M. Then, the second plug member 24 is fixed to the casing body 20 by crimping the casing or welding. In this manner, a pre-rolling assembly equivalent to the pre-rolling assembly 18 in the first embodiment is prepared.

Subsequently, at least two gas vent holes are formed in either one of the first and second plugs of the pre-rolling assembly (i.e., the casing 10' having the mixed powder M packed in the casing body 20), which serves as a top wall of the pre-rolling assembly in the rolling posture, in the same manner as that in the first embodiment. Then, the pre-rolling assembly will be subjected to a preheating process and a rolling process to obtain an end product.

A verification test using the casing 10' in the second embodiment which has a shape different from that of the casing 10 in the first embodiment was carried out in the same manner as that in the first embodiment (Examples 1 to 3). As a result, it was verified that the same advantages as those in the first embodiment can be reliably obtained.

Advantageous embodiments of the invention have been shown and described. It is obvious to those skilled in the art that various changes and modifications may be made therein without departing from the spirit and scope thereof as set forth in appended claims.

What is claimed is:

1. A method of producing a metal matrix composite material, comprising the steps of:

(a) mixing a metal powder and a ceramic powder to prepare a mixed powder;

(b) providing a metal casing having a lower casing member and an upper closing member, the upper closing member is adapted to seal the metal casing closed;

(c) placing the mixed powder into the lower casing member;

(d) sealing the metal casing filled with the mixed powder by placing the upper closing member on the lower casing member so as to prepare a pre-rolling assembly;

(e) preheating the pre-rolling assembly in such a manner so as to maintain the mixed powder in a powder state; and (f) rolling the pre-rolling assembly following said step of preheating to obtain the metal matrix composite material, where the metal matrix composite material includes a pair of metal plates having the mixed powder therebetween, wherein the upper closing member includes an open bottom and is adapted to be fitted onto an outer peripheral surface of the lower casing member from above in a surrounding manner so as to cover the lower casing member.

2. The method as defined in claim 1, wherein the step (c) further includes mechanical compacting the mixed powder in the metal casing to increase a density of the mixed powder.

3. The method as defined in claim 1, wherein the upper closing member and the lower casing member are made of the same material.

4. The method as defined in claim 1, wherein said step (f) includes positioning a longitudinal axis of the pre-rolled assembly to extend along a rolling direction and a surface thereof to be rolled is substantially disposed in a horizontal direction; and prior to said step (f), said method further includes reinforcing an outer peripheral surface of the metal casing with a reinforcing member for said step of rolling.

5. The method as defined in claim 4, said method further includes providing the reinforcing member of a same material as that of the metal casing.

6. The method as defined in claim 4, wherein said step of reinforcing includes using a reinforcing member having a thickness which is at least 4% of a length of the metal casing along a direction orthogonal to the rolling direction.

7. A method of producing an aluminum matrix composite material, comprising the steps of:

(a) mixing an aluminum powder and a ceramic powder to prepare a mixed powder;

(b) providing an aluminum lower casing having a rectangular shape with an open top, and an aluminum closing member formed in a shape adapted to hermetically close the open top of the lower casing;

(c) placing the mixed powder into the lower casing;

(d) closing the open top of the lower casing by the closing member so as to prepare a pre-rolling assembly;

(e) preheating the pre-rolling assembly in such a manner so as to maintain the mixed powder in a powder state; and (f) rolling the preheated assembly to obtain an aluminum matrix composite material, where the aluminum matrix composite material includes a pair of aluminum plates having the mixed powder therebetween, wherein said method includes providing the aluminum closing member formed to have a slightly greater size than that of the aluminum lower casing.

8. The method as defined in claim 7, wherein the step (c) further includes mechanical compacting the mixed powder in the aluminum lower casing to increase a density of the mixed powder.

9. The method as defined in claim 7, wherein the aluminum closing member includes an open bottom and is adapted to be fitted onto an outer peripheral surface of the aluminum lower casing from above in a surrounding manner so as to cover the aluminum lower casing.

10. The method as defined in claim 7, wherein said step of preheating includes preheating the pre-rolling assembly in an atmosphere to a temperature of 300 to 600° C.

11. The method as defined in claim 7, wherein said step of preheating includes preheating in an ambient atmosphere.

12. The method as defined in claim 7, wherein said step of preheating includes preheating in an inert gas atmosphere.

13. The method as defined in claim 7, wherein said step of preheating includes preheating in a vacuum atmosphere.

14. The method as defined in claim 7, wherein said step of rolling includes subjecting the pre-rolling assembly to hot rolling at a draft ranging from 10 to 70%.

15. The method as defined in claim 14, wherein said step of rolling includes subjecting the pre-rolling assembly to said hot rolling and then to warm rolling at a temperature of 200 to 300° C.

16. The method as defined in claim 15, wherein the method further includes warm rolling the assembly at a temperature of 200° C. or less after warm rolling at the temperature of 200 to 300° C.

17. The method as defined in claim 7, wherein said method further includes the step of heat treating at a temperature of 300 to 600° C. following said step of rolling.

18. The method as defined in claim 7, wherein:

wherein said step (f) includes positioning a longitudinal axis of the pre-rolled assembly to extend along a rolling direction and a surface thereof to be rolled is substantially disposed in a horizontal direction; and prior to said step (f), said method further includes reinforcing at least both side outer peripheral surfaces of the aluminum closing member, which extend in the rolling direction.

19. The method as defined in claim 18, wherein said reinforcing step includes fixing first and second reinforcing members to respective ones of opposed lateral surfaces of the aluminum closing member each parallel to the rolling direction, in such a manner so as to extend along the rolling direction, and fixing third and fourth reinforcing members to respective ones of front and rear surfaces of the aluminum closing member each orthogonal to the rolling direction, in such a manner so as to extend along a direction orthogonal to the rolling direction.

20. The method as defined in claim 18, wherein said step of reinforcing includes using first and second reinforcing members, each of the first and second reinforcing members having a width which is at least 4% of a length of the aluminum closing member along a direction orthogonal to the rolling direction.

21. The method as defined in claim 7, wherein said step (f) includes rolling the pre-rolling assembly to a shape ratio which is defined as H0/SQRT (R*(H0−H1)), wherein: H0 is a thickness of the pre-rolling assembly; H1 is a thickness of the assembly after rolling; R is a radius of a mill roll; and SQRT (R*(H0−H1) is a rolled amount of the assembly per revolution of the mill roll, and the shape ratio satisfying the following inequality:

$$H0/SQRT(R*(H0-H1))\leqq 1.0 \text{ or}$$

$$H0/SQRT(R*(H0-H1))\geqq 2.2.$$

* * * * *